United States Patent [19]

Barazone

[11] Patent Number: 4,699,330

[45] **Date of Patent: * Oct. 13, 1987**

[54] APPARATUS FOR LAYING PAVING FABRIC

[76] Inventor: Mounque Barazone, P.O. Box 5217, Cottonwood, Calif. 96022

[ * ] Notice: The portion of the term of this patent subsequent to Nov. 26, 2002 has been disclaimed.

[21] Appl. No.: 781,469

[22] Filed: Sep. 30, 1985

Related U.S. Application Data

[63] Continuation of Ser. No. 529,627, Sep. 6, 1983, Pat. No. 4,555,073.

[51] Int. Cl.[4] ..... E01C 19/48; B65H 16/06

[52] U.S. Cl. ..... 242/86.52; 404/94; 404/103

[58] Field of Search ..... 242/86.52, 86.5 R, 86.4, 242/86.6, 76, 58, 68.4; 15/78; 26/87; 56/16.2, 15.9; 404/83, 93, 94, 103, 122

[56] References Cited

U.S. PATENT DOCUMENTS

| | | | |
|---|---|---|---|
| 906,000 | 12/1908 | Emerson | 15/78 X |
| 1,544,662 | 7/1925 | Layton et al. | 15/78 |
| 1,895,045 | 1/1933 | Moore | 404/93 |
| 2,258,205 | 10/1941 | Halvorson | 404/103 |
| 2,546,308 | 3/1951 | Kahler | 404/94 |
| 3,632,054 | 1/1972 | Heppelmann | 242/86.52 X |
| 3,646,733 | 3/1972 | Clapsaddle, Jr. | 56/16.2 |
| 3,913,854 | 10/1975 | McClure | 242/86.52 X |
| 4,048,790 | 9/1977 | Zweegers | 56/13.6 |
| 4,066,093 | 1/1978 | Egerstrom | 242/86.2 X |
| 4,094,472 | 6/1978 | Berndt et al. | 242/54 R |
| 4,456,399 | 6/1984 | Conover | 404/83 X |
| 4,507,015 | 3/1985 | Furukawa et al. | 404/122 |

*Primary Examiner*—John M. Jillions
*Attorney, Agent, or Firm*—Bielen & Peterson

[57] ABSTRACT

The vehicle mounted apparatus for laying paving fabric from a roll on a surface utilizing a first structural member having a lateral transverse dimension. A second structural member also includes a lateral dimension in a spaced relationship from the first member. The roll of paving fabric is mounted on the second member and permitted to unwind to lay the fabric over the surface as the vehicle moves. A downward force is exerted on the unwound paving fabric. The second member includes an adjustment mechanism to accommodate different sized rolls.

12 Claims, 7 Drawing Figures

APPARATUS FOR LAYING PAVING FABRIC

This is a continuation of application Ser. No. 529,627 filed Sept. 6, 1983, now U.S. Pat. No. 4,555,073.

BACKGROUND OF THE INVENTION

The present invention relates to a novel and useful appratus for laying paving fabric.

A recent development in the construction and repair of asphalt surfaces includes the laying of a sheet of paving fabric generally formed from polypropylene, polyethylene or the like. It has been found that the use of paving fabric permits the binding of the old asphalt to the new asphalt overlay while maintaining a moisture impermeable barrier. The result is that reflective cracking of asphalt surfaces is prevented in the future.

In the past the paving fabric has been placed down manually but this has proved to be unsatisfactory since the sheet material being unrolled must be aligned with the paving surface perimeter and must be free of wrinkles. Reference is made to the U.S. Pat. No. 3,913,854 to McClure which describes a device for tensioning fabric rolls. The prior art fabric roll laying devices suffer from the inability to accommodate different sized rolls and the elimination of wrinkles from the fabric after it is placed on the surface being paved. In addition, the prior devices have being unwieldy and are not compactly transported from one worksite to another.

A paving machine which overcomes the obstacles and shortcomings of the devices of the prior art would be a great advance in the field of constructing and repairing paved surfaces.

SUMMARY OF THE INVENTION

In accordance with the present invention a novel apparatus for laying paving fabric is provided.

The device of the present application is normally vehicle mounted and dispenses paving fabric from a roll. The apparatus employs a first member which has a lateral or transverse dimension and a second member having a lateral or transverse dimension such that the members are spaced from one another. The roll is supported from the second member and permitted to unwind with vehicle movement. The fabric is then laid over the surface in this manner.

Means is also used for applying a downward force on the unwound paving fabric as it passes beneath the vehicle. Said force applying means is connected to the first member. Such means for applying a downward force on the unwound paving fabric may include a first element and a second element lying adjacent first element and being angularly disposed in relation to the same.

The means for applying a downward pressure or force on the unwound paving fabric may include brushes in the form of first and second elongated brush units each connected to said first and second elements respectively. The brush units may form an angle with the apex of the angle lying closer to the fabric than the legs of the angle. Thus, a Vee or a chevron is formed which points toward the direction of travel of the vehicle. The first and second elements may be supported by said second member, although a portion of the first and second elements remains spaced from the second member.

Means is also found to adjust the downward force provided by the means for applying the downward force.

The apparatus of the present invention may also embrace the use of means for adjusting the lateral dimension of the second member. Such adjustment may take the form of one or more sections being telescopically movable in relation to one another. Of course, the means for supporting the roll would be attached to an elongated section of the telescopically movable sections.

To maintain the tension on the roll, a bar may be connected to either the first or second member between the fabric roll and the surface. The bar may take the form of a cylindrical member fastened to arms extending from the first or second members. In addition, a platform may be provided on these arms to steady or hold the fabric roll as it is being loaded on the machine.

The apparatus of the present invention may also entail the provision for means for rotating a portion of the first and second members upwardly. Such rotation would place the apparatus in a compact configuration that adds to the mobility of the apparatus.

It may be apparent that a novel and useful appartus for laying paving fabric has been described.

Is therefore an object of the present invention to provide an apparatus for laying paving fabric from a roll on a surface which may be operated by a person having a minimum of training and experience.

Another object of the present invention is to provide an apparatus for laying paving fabric which lays the fabric in proper alignment and without wrinkles.

It is yet another object of the present invention to provide an apparatus for laying paving fabric which may employ paving fabric rolls of various sizes.

Another object of the present invention is to provide an apparatus for laying paving fabric which may be collapsible in part to facilitate transportation of the apparatus from job site to job site.

The apparatus possesses other objects and advantages especially as concerns particular characteristics and features which will become apparent as the specification continues.

Figures 1, 6:
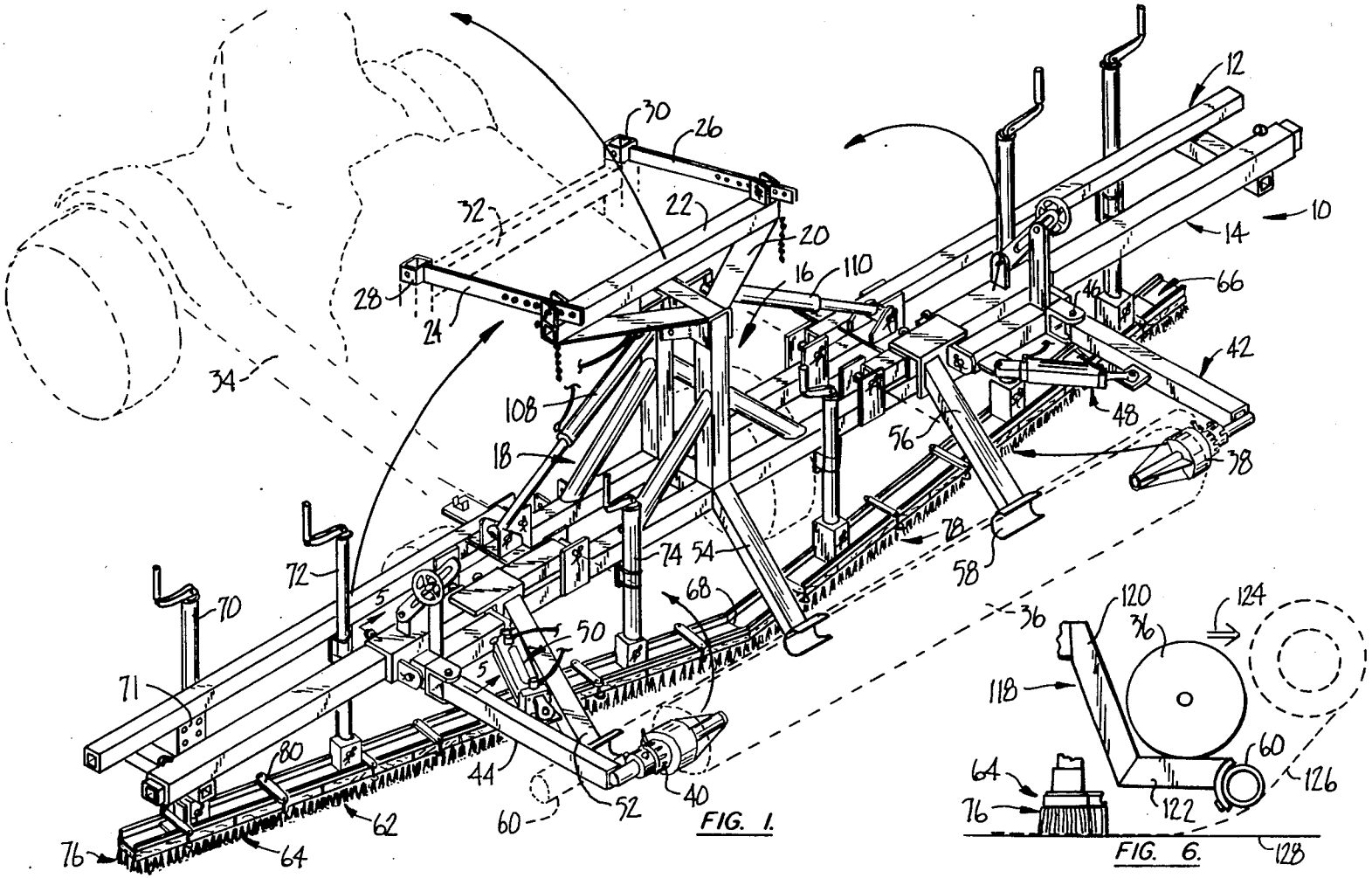
FIG. 1 is a top left side perspective view of the apparatus of the present invention showing the motivating vehicle in phantom.
FIG. 6 is a side view of an embodiment of the rod supporting arm.

For a better understanding of the invention reference is made to the following detailed description of the embodiments of the present invention which should be referenced to the hereinabove drawings.

DETAILED DESCRIPTION OF THE PREFERRED EMBODIMENTS

The apparatus as a whole is shown by reference character 10 in the drawings.

The fabric laying machine 10 includes as one of its elements a first structural member 12 and a second structural member 14. Members 12 and 14 extend transversely and laterally in relation to the paving surface. First member 12 and second member 14 are also spaced in relation to one another in that first member 12 lies behind second member 14. A post member 16 holds first and second members in cantilever fashion. Braces 18 aid in this disposition. A bracket 20 connects to beam 22. Bracket arms 24 and 26 connect to collars 28 and 30 respectively, which fit on support means 32 provided by vehicle 34.

A roll 36 (shown in phantom) is held by tensioning spools 38 and 40 such as the tensioning spool shown in U.S. Pat. No. 3,913,854. Supports 42 and 44 hold tensioning spools in place and are substantially identical in construction to one another. Support 42 include a pivot 46 which is moved by hydraulic means 48. The movement about pivot 46 would cause tensioning spools 38 and 40 to generally move in or out of roll 36. The hydraulic means 48 is shown in part as a hydraulic cylinder. The remaining portions of hydraulic means 48 are of conventional configuration. Likewise, hydraulic means 50 would similarly operate support 44.

Arms 52, 54, and 56 extend from second member 14 downwardly at an angle. By exemplar arm 56 includes a semi-cylindrical termination for holding a rod or pipe 60. Unwound fabric from roll 36 would pass beneath pipe 60 and to the surface, as will be hereinafter explained.

Figure 3:
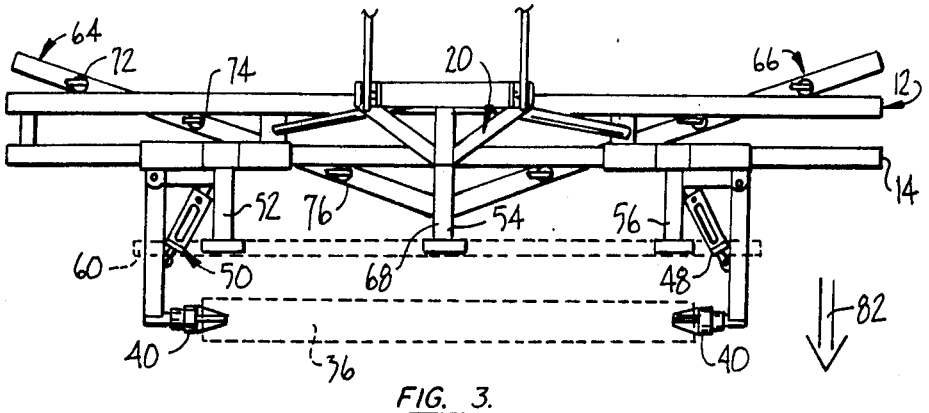
FIG. 3 is a top plan view showing schematically portions of the apparatus.

Means 62 is also included in the present invention for applying a downward force on the unwound paving fabric. Means 62 may take the form of a first element 64 and a second element 66 which meet at an apex or point of abutment 68. First and second elements may be included as an integral part of first structural member 12 or formed separately as shown in FIG. 1. By way of illustration first element 64 is held to a jack 70 by plate 72. Jack 70 would constitute means for adjusting the downward force or pressure of first element 64. Likewise, jack 72 and jack 74 are fixed to second member 14. Brush units 76 and 78 are fixed to the bottom portions of elements 64 and 66 by the plurality of brackets such as bracket 80. Of course, brush units 76 and 78 may be held to first and second elements 64 and 66 by any other known fastening means. Referring to FIG. 3 it may be seen that first and second elements 64 and 66 form a Vee or chevron pointing in the direction of movement of the apparatus 10 shown by directional arrow 82. It has been found that this angle of configuration of the brush units 64 and 66 greatly contributes to the removing of wrinkles from the paving fabric being unwound from roll 36 as it is placed on the surface 128.

Figure 2A:
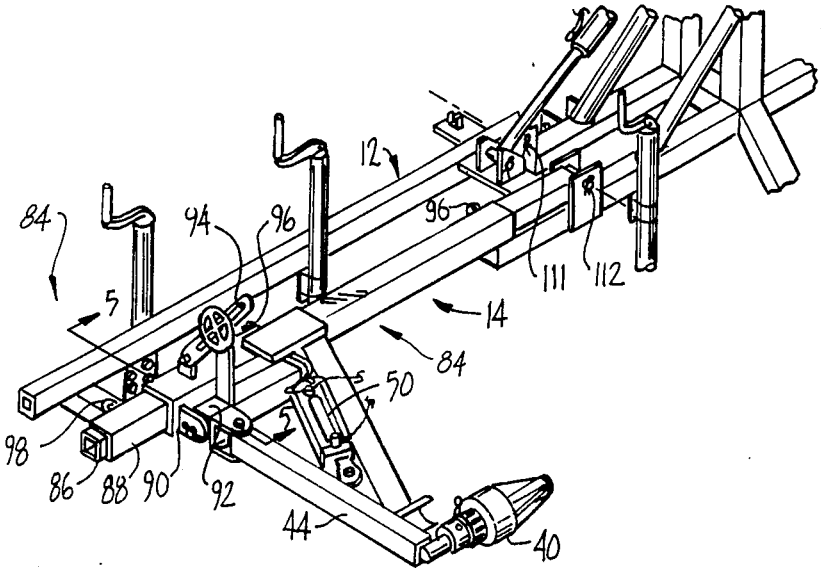
FIG. 2A is a top left side perspective view of the apparatus of the present invention depicting the telescoping feature.
Figure 2B:
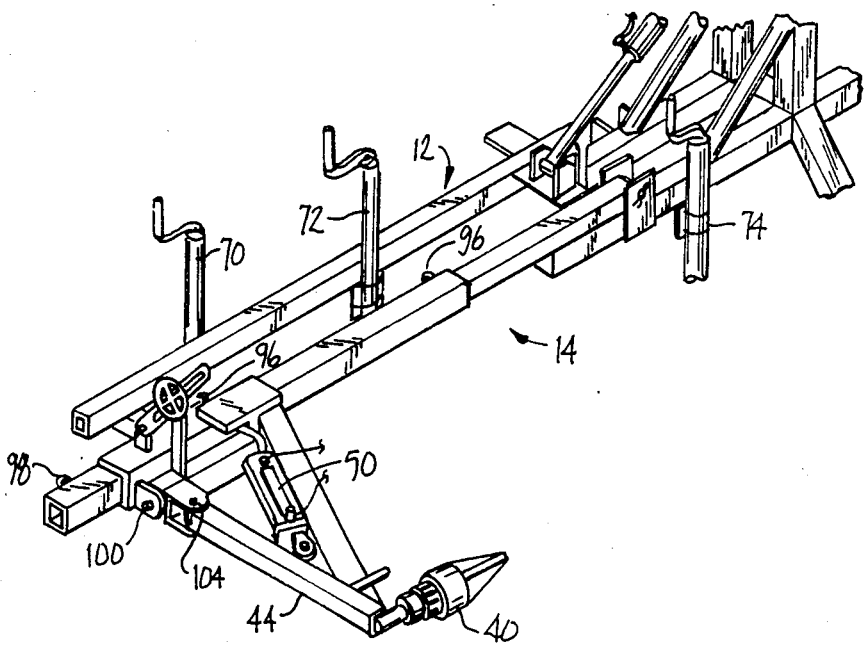
FIG. 2B is a top left side perspective view of the apparatus depicting the telescoping feature.

The paving apparatus 10 also includes means 84 for adjusting the lateral dimension of the second member 14. With reference to FIGS. 2A and 2B it may be seen that second structural member 14 includes an inner or first elongated section 86, a middle or second elongated section 88, and an outer or third elongated section 90. It should be noted that FIGS. 2A and 2B depict the left side of apparatus 10 and that the means for adjusting member 14 includes a similar mechanism for the right side of apparatus 10. With reference to FIG. 2A it may be seen that support 44 is connected to third elongated section 90 by the use of the pivot block 92. Adjustment means 94 permits the rotation of support 44 upwardly and downwardly as needed to properly tension the roll 36. A set screw or pin 98 is removed to permit the third elongated section to slide over second elongated section 88. The removal of pin 98 will permit the second section 88 to slide over the top of first section 86, shown in FIG. 2B. Thus, support 44 may be moved laterally by the use of means 84. In addition, adjustment means 94 permits rotation of spool upwardly and downwardly and hydraulic means 50 would permit the rotation of spool 40 inwardly and outwardly.

Figure 5:
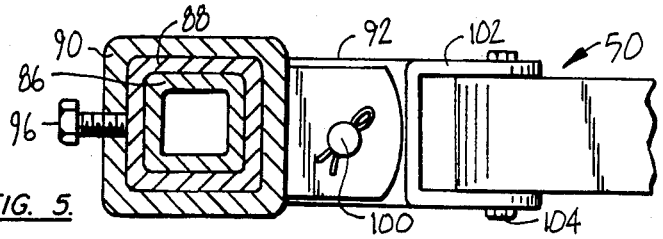
FIG. 5 is a view taken along line 5—5 of FIG. 2A.

With reference to FIG. 5 it may be seen that one of set pins 96 is shown holding third section 90 to second section 88. Pivot block 92 includes a pivoting rod 100 while hydraulic means 50 is shown to include u-shaped bracket 102 and hinge pin 104.

Figure 4:
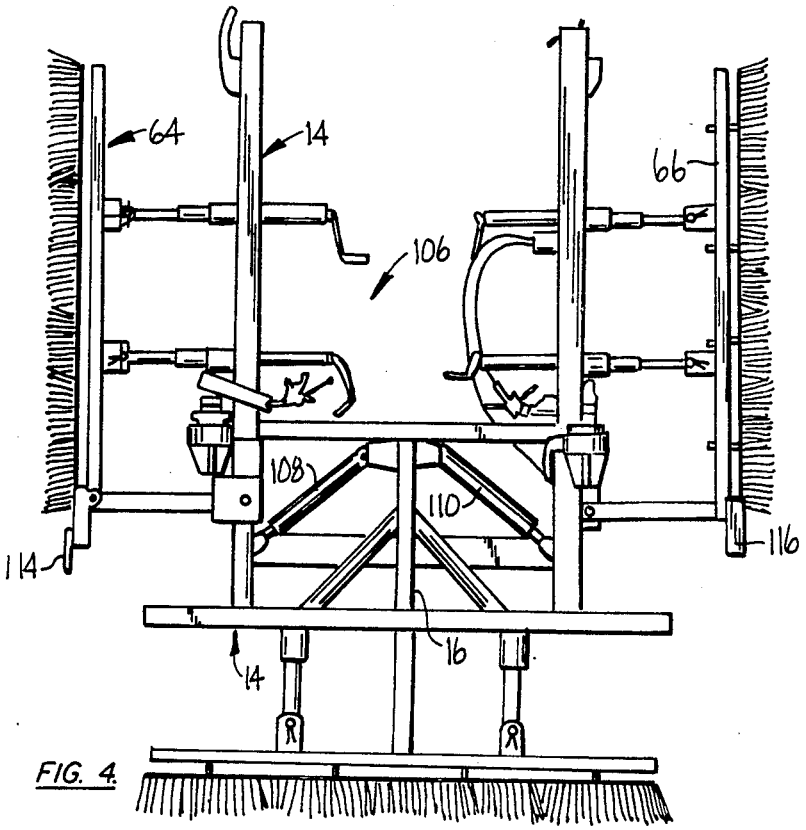
FIG. 4 is a front elevational view of the apparatus showing the upward movements of portions of the apparatus.

Turning to FIG. 4 it may be seen that apparatus 10 further comprises means 106 for rotating a portion of first and structural members 12 and 14 upwardly. Means 106 includes hydraulic cylinders 108 and 110 operated by a conventional hydraulic system such as one having a three quarter ton capacity, $11\frac{1}{4}''$ stroke manufactured by A.R.P.S. Manufacturing Inc. In comparison, the hydraulic cylinder systems 48 and 50 would be similar to one having a seven ton capacity and a 6" stroke manufactured by Lantex Hydraulics, Inc. of Lancaster, Tex. Moreover, the screw adjustment jacks 70, 72 and 74 as well as the jacks shown on the right side of the apparatus 10 may be of the type having a 2" diameter $1\frac{1}{2}$ ton capacity manufactured by Atwood Jacks. Hydraulic jacks may be used instead.

First and second members 12 and 14 rotate about pivots 111 and 112. Again, similar rotation pins may be found on the right side of apparatus 10, FIGS. 2A, 2B and FIG. 1. Returning to FIG. 4 it may be seen that brush units 64 and 66 split and include brackets 114 and 116 to removably fasten the same together.

With reference to FIG. 6 it may be seen that any one of arms 52, 54 or 56 may include the construction shown by arm 118. Arm 118 includes a diagonal section 120 and a horizontal bracket 122 which serves as a resting place for roll 36 before being loaded on the tensioning spools 38 and 40. Directional arrow 124 shows the movement of roll 36 and the unwinding of the fabric sheet 126 onto surface 128 and beneath brush unit 76.

In operation the operator of apparatus 10 would load fabric roll 36 onto tensioning spools 38 and 40. The sheet on 26 would be unwound and led over bar 60 to the bottom of brush units 76 and 78. Means 84 would adjust the proper lateral spacing between tensioning spools 38 and 40 while hydraulic means 48 and 50 would force tensioning spools 38 and 40 into roll 36 as desired. Adjustment means 94 would rotate the roll 36 upwardly or downwardly as necessary to achieve the proper height of the roll above bar 60. The vehicle 34 would than be moved forward and the sheet 126 would be pressed onto surface 128 in a wrinkle-free manner. Jacks 70, 72, 74 and the others hereinbefore referenced would be adjusted as needed to apply the proper force of the brush unit 76 and 78 to the unwound sheet 126. After use of apparatus 10, means 106 would be employed to raise the outer extremities of first and second members 12 and 14 for the sake of storing or transporting apparatus 10 from one job site to another job site.

I claim:

1. A vehicle mounted apparatus for laying paving fabric unwound from a roll on a surface comprising:

a. a first member having a lateral dimension, said first member being connectable to the vehicle;

b. a second member having a lateral dimension, said second member being transversely spaced from said first member and being supported thereto, said second member being positioned apart from the roll between the roll and said first member;

c. means for supporting the roll from said second member, permitting the roll to unwind with vehicle movement and for laying the fabric over the surface;

d. means for applying a downward force on the unwound paving fabric, said means being connected to at least said first member; and e. means for adjusting said lateral dimension of said second member.

2. The vehicle mounted apparatus of claim 1 in which said means for applying a downward force on the unwound paving fabric includes a first element and a second element lying adjacent said first element and being angularly disposed in relation to said first element, and said first and second elements include first and second elongated brush units respectively.

3. The vehicle mounted apparatus of claim 1 in which said first and second brush units include first and second end portions respectively which abut one another to form an apex which lies closer to the fabric roll than the remaining portions of said first and second elements.

4. The vehicle mounted apparatus of claim 3 in which said first and second elements are supported from said first and second members.

5. The vehicle mounted apparatus of claim 1 which additionally comprises means for adjusting said downward force provided by said means for applying a downward force on the unwound paving fabric.

6. The vehicle mounted apparatus of claim 1 in which said means for adjusting said lateral dimension of said second member includes a first elongated section, and a second elongated section, said first elongated section being telescopically movable in relation to said second elongated section.

7. The vehicle mounted apparatus of claim 6 in which said means for supporting the roll from said second member includes at least one connector between said first elongated section and the roll.

8. The vehicle mounted apparatus of claim 7 which additionally comprises a bar selectively connected to said first and second member, said bar contacting said fabric before touching the surface and after being unwound from the roll.

9. The vehicle mounted apparatus of claim 8 which further comprises means for rotating a portion of said first and second members upwardly.

10. The vehicle mounted apparatus of claim 9 in which said bar includes platform means for holding the roll before supporting the roll from said means for supporting the roll from said second member.

11. A vehicle mounted apparatus for laying paving fabric from a roll on a surface comprising:

a. a first member having a lateral dimension;

b. a second member having a lateral dimension, said second member being transversely spaced from said first member, said second member being positioned apart from the roll between the roll and said first member;

c. means for supporting the roll from said second member, permitting the roll to unwind with vehicle movement and for laying the fabric over the surface;

d. means for applying a downward force on the unwound paving fabric, said means for applying a downward force on the unwound paving fabric being supported selectively to said first and second members, said means for applying a downward force on the unwound paving fabric further including a first element and a second element lying adjacent said first element, said first element being angularly disposed in relation to said second element to form an apex which lies closer to the fabric roll than the remaining portions of said first and second elements.

12. A vehicle mounted apparatus for laying paving fabric from a roll on a surface comprising:

a. a first member having a lateral dimension;

b. a second member having a lateral dimension, said second member being transversely spaced from said first member, said second member being positioned apart from the roll between the roll and said first member;

c. means for supporting the roll from said second member, permitting the roll to unwind with vehicle movement and for laying the fabric over the surface;

d. means for applying a downward force on the unwound paving fabric, said means for applying a downward force on the unwound paving fabric being supported to said first and second members, said means for applying a downward force on the unwound paving fabric further including a first element and a second element lying adjacent said first element, said first element being angularly disposed in relation to said second element to form an apex which lies closer to the fabric roll than the remaining portions of said first and second elements.

* * * * *